US005479970A

United States Patent [19]

Trani

[11] Patent Number: 5,479,970

[45] Date of Patent: Jan. 2, 1996

[54] FUNNEL

[76] Inventor: Christopher R. Trani, 1906 Radcliff Ave., Bronx, N.Y. 10462

[21] Appl. No.: 339,163

[22] Filed: Nov. 10, 1994

[51] Int. Cl.[6] ..... B65B 39/00; B67C 11/00

[52] U.S. Cl. ..... 141/297; 141/299; 141/384; 141/364; 222/481.5

[58] Field of Search ..... 141/297, 298, 141/299, 289, 300, 320, 369, 374, 378, 384, 367, 364, 366, 383; 222/481.5, 568

[56] References Cited

U.S. PATENT DOCUMENTS

| | | | |
|---|---|---|---|
| 334,564 | 1/1886 | Catlin | 141/299 |
| 1,357,490 | 11/1920 | Farlinger | 141/299 |
| 1,651,963 | 12/1927 | Mooney | 141/297 |
| 2,556,627 | 6/1951 | Miksis | 222/568 |

*Primary Examiner*—Henry J. Recla
*Assistant Examiner*—Steven O. Douglas
*Attorney, Agent, or Firm*—John B. Dickman, III

[57] ABSTRACT

An air removal adaptor for removing air from a container as it is being filled with a liquid from a funnel attached to the air removal adaptor. The air removal adaptor has a cylindrical housing with a fill spout and an air vent for carrying air from a container to a cavity in the housing and a passageway to remove the air to the atmosphere.

4 Claims, 1 Drawing Sheet

FUNNEL

BACKGROUND OF THE INVENTION

This invention relates to funnels for filling containers, and in particular, to an air pressure removal adaptor.

Heretofore, the prior art funnels having means to remove air pressure from a container as it is being filled by a liquid are provided with passages to carry air up through the funnel. An example of one such funnel is found in U.S. Pat. No. 426,667—Grissim, where a funnel having a frusto-conical liquid holding container with a large open end for pouring liquid into the liquid holding container and a small open end for dispensing liquids. A frusto-conical spout is connected to the small open end of the holding container. The Grissim funnel has a double wall construction whereby as a liquid is dispensed from the funnel any air in the container is forced between the double wall and out the top of the funnel.

Another U.S. patent having a passage for removing air is U.S. Pat. No. 766,616—Hagenbach. The small dispensing end of the frusto-conical shaped liquid holding container is attached to a screw threaded bottom. A cap screws into the screw threaded bottom. The cap has a conical lower end, adapted to fit into the mouth of a bottle, and a center opening which surrounds a tube of suitable length to extend near the bottom of the bottle. Air escapes through the opening in the cap, and into an air-tube which extends a little below the upper edge of the funnel down through the bottom of the funnel and into a cavity formed between the screw threaded bottom and the cap.

U.S. Pat. No. 4,494,585—Waldecker, discloses a funnel having vent tube down through the funnel outlet end to the mouth of the outlet.

The vent means in U.S. Pat. No. 5,074,343—Tyree includes a plurality of vent holes in a funnel displacer section. Air escapes from a bottle through the vent holes and through the fluid filling the bottle.

SUMMARY OF THE INVENTION

This invention provides an air removal adaptor for a funnel which includes a cylindrical housing with a screw threaded upper end and a center bore which provides a dispensing tube. Surrounding the dispensing tube is a screw threaded bottle cap which fits on the mouth of a bottle to be filled. The dispensing tube has a built-in air vent which extends part way up the exterior of the tube. Between the screw threaded upper end and the screw threaded bottle cap is a cavity with connection to a conduit that opens to the outside of the housing. Air forced from the bottle being filled by a fluid escapes through the air vent into the cavity and out through the conduit.

A funnel having a frusto-conical shape and a screw threaded dispensing end is screwed into the screw threaded upper end. The funnel may take on several shapes providing there is present a screw threaded dispensing end.

In those situations where the mouth of the bottle is of a different size than the screw threaded bottle cap, a bottle adaptor is provided. The bottle adaptor has a screw threaded spout which screws into the screw threaded bottle cap and a larger screw threaded bottle mouth cap. A plurality of different sizes of bottle adaptors would be made available to cover a variety of bottle mouth sizes.

DESCRIPTION OF THE INVENTION

Figure 1:
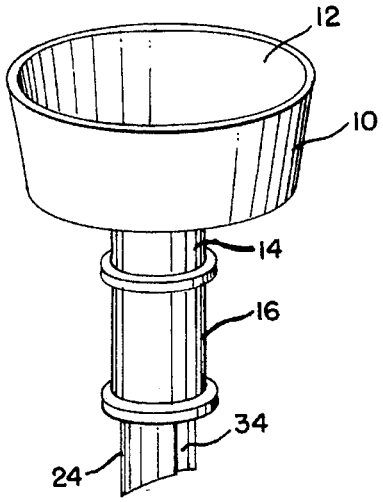
FIG. 1 is a perspective view of a funnel screw threaded into an air removal adaptor of the invention.
Figure 2:
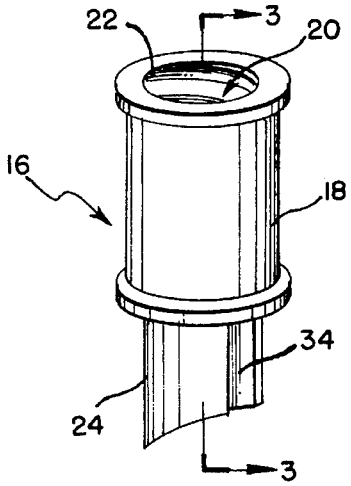
FIG. 2 is a perspective view of an air removal adaptor of the invention.
Figure 3:
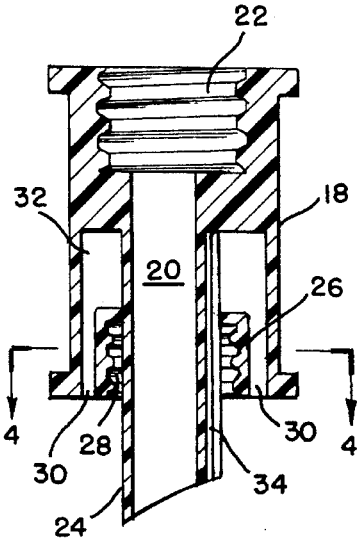
FIG. 3 is a cross-sectional view of an air removal adaptor of the invention taken along the line 3—3 of FIG. 2.
Figure 4:
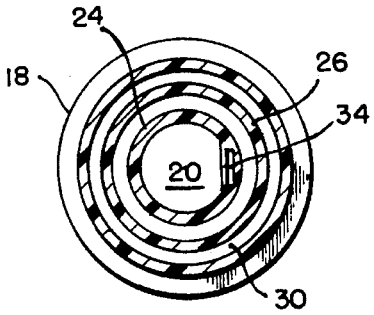
FIG. 4 is a cross-sectional view of an air removal adaptor of the invention taken along the line 4—4 of FIG. 3.

Illustrated in FIGS. 1 to 6 is a funnel and air removal adaptor which is designed to remove air from a bottle as it is being filled with a liquid. It is well known that in order to fill a bottle or container with a liquid the ambient air in the bottle must be removed to make space for the liquid. In FIG. 1, a funnel 10 having a frusto-conical shape with an open end 12 and a dispensing end 14 is screw threaded into an air removal adaptor 16. The funnel may have different shapes providing the dispensing end will screw thread into the air removal adaptor 16.

The air removal adaptor 16 has a cylindrical housing 18 with a center bore 20. In the inside upper area of the housing 18 is a screw threaded connector 22 for attaching the air removal adaptor to funnel 10. Extending from the connector 22 through the bottom of the cylindrical housing 18 is an extension tube 24 of the funnel 10, which remains with the air removal adaptor 16. Integral with extension tube 24 and molded to the exterior of the tube is a bottle cap 26. There are screw threads 28 on the inside of the bottle cap 26 for screwing the air removal adaptor 16 on a bottle mouth, not shown. Between the outside of the bottle cap 26 and the inside wall of the cylindrical housing is a passage 30. Connected to passage 30 is a cavity 32 which is defined by the end of connector 22 and the top of bottle cap 26. A groove 34 in extension tube 24 provides an air vent to remove air from a bottle. Groove 34 connects the inside of a bottle with cavity 32, consequently, air forced from a bottle moves through groove 34, cavity 32 and passage 30 to the outside.

Figure 5:
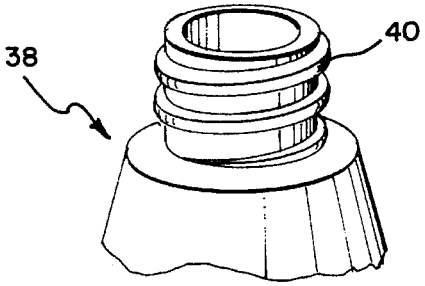
FIG. 5 is a perspective view of a bottle adaptor to screw thread on to an air removal adaptor of the invention and on a bottle mouth.
Figure 6:
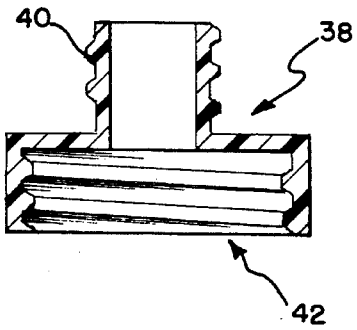
FIG. 6 is a cross-sectional view of a bottle adaptor of FIG. 5.

In order to use the air removal adaptor 16 with different size bottle mouths FIGS. 5 and 6 show a bottle adaptor 38. The bottle adaptor 38 has a screw threaded spout 40 which screws into the screw threaded bottle cap 26, and a large screw threaded bottle mouth cap 42. The bottle adaptor 38 may have different size bottle mouth caps to accomodate different bottle mouths.

While only one embodiment of the invention has been shown, it is understood that one skilled in the art may realize other embodiments of the invention; therefore, one should look to the claims, specification and drawings for a complete understanding of the invention.

I claim:

1. An air removal adaptor for funnels to remove air from a container being filled with a liquid poured into one of the funnels, comprising:

a cylindrical housing having a center bore extending through said cylindrical housing from a first end to a second end thereof;

a first connector means integrally formed in said housing and projecting from said first end to an intermediate point in said center bore and having screw threads in said center bore adapted to receive a funnel having a screw threaded pouring spout;

a pour spout in said center bore extending from said intermediate point beyond said second end of said housing, wherein said pour spout is adapted to be inserted into a container to be filled;

an air vent means connected to said pour spout where said pour spout has an exterior surface and said air vent means is formed integral with said exterior surface and isolated from said center bore;

a second connector means integrally formed on the exterior surface of said pour spout for attaching said cylindrical housing to a container to be filled; and, an air dispensing means including an air cavity connected to said air vent means and a passageway connected to said air cavity and terminating in an opening in said second end of said cylindrical housing, wherein said opening is to the atmosphere.

2. An air removal adaptor as in claim 1 wherein said air vent means is a groove extending from said air cavity to beyond said second end.

3. An air removal adaptor as in claim 2 wherein said second connector means is a screw threaded cap adapted for screwing on a container having a screw threaded opening.

4. An air removal adaptor as in claim 3 further comprising a bottle adaptor having a screw threaded spout for screw threading on said second connector connected to a screw threaded bottle cap wherein said screw threaded bottle cap is of a greater diameter than said screw threaded spout.

* * * * *